United States Patent [19]

Rosenthal

[11] Patent Number: 4,769,589

[45] Date of Patent: Sep. 6, 1988

[54] LOW-VOLTAGE, TEMPERATURE COMPENSATED CONSTANT CURRENT AND VOLTAGE REFERENCE CIRCUIT

[75] Inventor: Bruce D. Rosenthal, Los Gatos, Calif.

[73] Assignee: Teledyne Industries, Inc., Mountain View, Calif.

[21] Appl. No.: 117,248

[22] Filed: Nov. 4, 1987

[51] Int. Cl.[4] ..... G05F 3/26

[52] U.S. Cl. ..... 323/313; 323/315; 323/907

[58] Field of Search ..... 323/304, 312, 313, 314, 323/315, 316, 907; 330/288

[56] References Cited

U.S. PATENT DOCUMENTS

| | | | |
|---|---|---|---|
| 4,442,398 | 4/1984 | Bertails et al. | 323/315 |
| 4,450,367 | 5/1984 | Whatley | 323/315 |
| 4,481,483 | 11/1984 | Kawamura | 330/288 |

FOREIGN PATENT DOCUMENTS

| | | | |
|---|---|---|---|
| 245007 | 12/1985 | Japan | 323/313 |

*Primary Examiner*—William H. Beha, Jr.
*Attorney, Agent, or Firm*—Fliesler, Dubb, Meyer & Lovejoy

[57] ABSTRACT

The reference circuit includes a current mirror for providing first and second current paths for the conduction of respective first and second currents. The current mirror imposes a current level relationship between the first and second currents. A load, preferably resistive, is provided in the first current path for predominantly establishing a predetermined level of the first current. A transistor having a temperature coefficient of a predetermined polarity and a resistor having a temperature coefficient of a complimentary polarity are provided in the second current path for providing temperature compensation. Finally, a load compensation stage is provided in the first and second current paths to provide a thermal compensation feedback path from the transistor and resistor compensation elements to permit stabilization of the first current level with respect to temperature.

20 Claims, 1 Drawing Sheet

LOW-VOLTAGE, TEMPERATURE COMPENSATED CONSTANT CURRENT AND VOLTAGE REFERENCE CIRCUIT

FIELD OF THE INVENTION

The present invention is generally related to current and voltage reference circuits employing temperature compensation and, in particular, to a reference circuit having a temperature compensated output characteristic that can be optimized to establish either a constant current or a constant voltage reference level, or both, from source potentials as low as approximately 1.5 volts.

BACKGROUND OF THE INVENTION

Quite often integrated analog system components must be designed to operate in close conjunction with digital logic. Further, a typical desire is to fabricate related, if not mutually supportive, analog and digital system components on a common die. Close functional integration of analog and digital is naturally desirable for the ability to form high-level functional blocks. In any of these cases, the analog system components are typically required to operate from a common semiconductor, typically digital voltage supply level. This requirement is often a simple expedient arising from the cost effectiveness of using only a single, fixed potential power supply, such as a battery. Therefore, analog system components are often required to operate from power supply differences of between 1.5 and five volts, or more, over the age of a battery without loss of operational accuracy.

Typically, the accuracy of an analog system component will depend on the accuracy of its internal current and voltage reference circuits. Conventional current references utilize a Zener diode to accurately establish a reference voltage level. A reference current level can be derived from the reference voltage level through the conventional use of a simple current mirror amplifier circuit. However, the fabrication of an integrated Zener diode having a Zener threshold ($V_z$) of less than about 6.2 volts is difficult and generally impractical particularly where other integrated devices are to be fabricated on the same substrate. To achieve Zener thresholds of incrementally less than 6.2 volts requires progressively higher doping densities in the fabrication of the diode. Such high doping densities are generally incompatible with the fabrication of other analog and digital components. Therefore, Zener diode based reference circuits are generally not used where the power supply potential difference is less than approximately 7 volts.

Band-gap reference circuits provide an alternate approach to obtaining reference current levels from low voltage supplies. Band-gap references generally rely on a difference between the semiconductor band-gaps of active semiconductor devices. However, band-gap references are quite complex to fabricate as compared to Zener references, are quite sensitive to fabrication process variations and require a well-behaved amplifier in the necessary reference level control feedback loop in order to maintain stable operation. Additionally, band-gap references typically require a relatively large integrated device surface area due to their circuit complexity.

SUMMARY OF THE INVENTION

Therefore, a general purpose of the present invention is to provide temperature compensated voltage and current level reference circuit capable of operating from low supply voltages.

This is achieved by the present invention through the provision of a circuit for providing an output reference level that is fixed with respect to temperature. The circuit includes a current mirror for providing first and second current paths for the conduction of respective first and second currents. The current mirror imposes a current level relationship between the first and second currents. A load, preferably resistive, is provided in the first current path for predominantly establishing a predetermined level of the first current. A transistor having a temperature coefficient of a predetermined polarity and a resistor having a temperature coefficient of a complimentary polarity are provided in the second current path for providing temperature compensation. Finally, a load compensation stage is provided in the first and second current paths to provide a thermal compensation feedback path from the transistor and resistor compensation elements to permit stabilization of the first current level with respect to temperature.

Thus, an advantage of the present invention is that it is capable of providing a stable current or voltage reference level insensitive to operating environment conditions including temperature and power source potential difference variations.

Another advantage of the present invention is that it is capable of stable operation from power source potential differences of down to approximately 1.5 volts while maintaining a high power-supply-rejection-ratio. The present invention is therefore imminently capable of operating in conjunction with conventional integrated digital logic and battery based power supplies.

A further advantage of the present invention is that it employs an efficient, low circuit component count design. Therefore, a highly die-area efficient integrated circuit implementation of the present invention can be readily achieved. The use of few, well characterized integrated components directly yields a high degree of operational reliability, low design cost and relatively minimal implementation complexity.

Still another advantage of the present invention is that the circuit components, power supply requirements, and design circuit and layout of the present invention are fully compatible with and producible by standard CMOS design and fabrication processes. Through the use of well characterized integrated circuit components, the present invention is generally not sensitive to nominal fabrication process variation.

BRIEF DESCRIPTION OF THE DRAWINGS

These and other advantages of the present invention will become apparent and readily appreciated as the same becomes better understood by reference to the following detailed description when considered in connection with the accompanying drawing and wherein:

The FIGURE provides a circuit schematic of a preferred integrated circuit embodiment of the present invention.

DETAILED DESCRIPTION OF THE INVENTION

Figure 1:
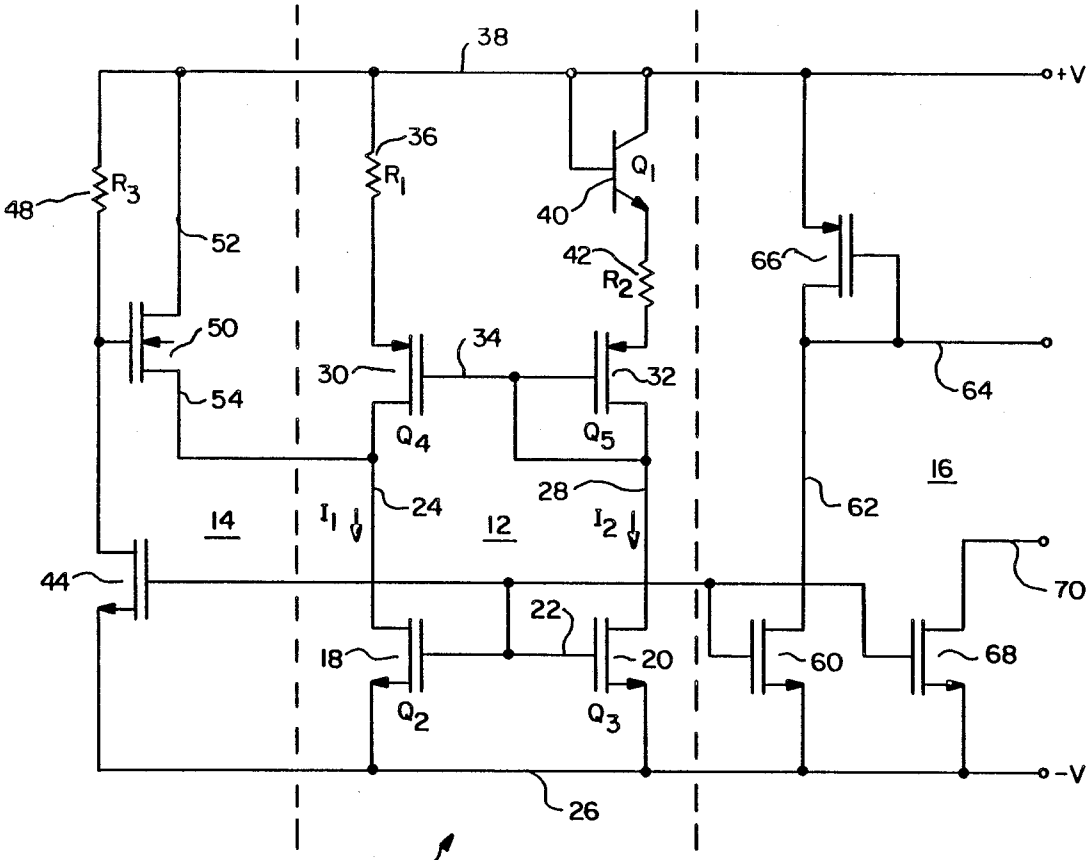

A circuit diagram of the low voltage, temperature compensated reference circuit, generally indicated by the reference numeral 10 and exemplary of a preferred embodiment of the present invention, is shown in FIG. 1. The reference 10 is shown as including a low voltage capable, temperature compensated reference circuit 12, exemplary power-on bootstrap circuit 14 and exemplary output circuit stage 16.

The reference circuit 12 includes a current mirror configured pair of enhancement mode NMOS transistors 18, 20. The gates 22 of the transistors 18, 20 are connected in common to the source 24 of the transistor 18. The drains of the transistors 18, 20 are commonly connected to a negative source potential (−V) via conductor 26. The current relationship between a current $I_1$ through transistor 18 and $I_2$ through transistor 20 is defined by Equation 1.

$$I_2 = kI_1 \qquad \text{Eq. 1}$$

where k is a proportionality constant defined as the ratio of the width to length dimensions of the active channel of transistor 20 with respect to the width to length dimensions of the active channel of transistor 18.

A current mirror amplifier, constructed from a pair of enhancement mode PMOS transistors 30, 32 are provided such that the source of transistor 30 is connected in series with the drain 24 of transistor 18 and the source of transistor 32 is connected in series with the drain 28 of transistor 20. The gates 34 of the transistors 30, 32 are connected in common to the source 28 of transistor 32. The drain of transistor 30 is coupled in series through a resistor 36 ($R_1$) to a positive source potential (+V) provided on a conductor 38. An NPN type, diode connected bipolar transistor 40 ($Q_1$) provides a current path for the current $I_2$ from the conductor 38 through a series connected resistor 42 ($R_2$) to the drain of transistor 32. The loop equation for the uppermost loop of the reference circuit 12 is given by Equation 2.

$$I_1R_1 + V_{GS30} = V_{be} + I_2R_2 + V_{GS32} \qquad \text{Eq. 2}$$

Transistors 30 and 32 can be presumed to have essentially identical operating characteristics due to their common design and close integration together on a common substrate. Therefore, Equation 2 essentially reduces to Equation 3.

$$I_1R_1 = V_{be} + I_2R_2 \qquad \text{Eq. 3}$$

By substituting Equation 1 into Equation 3, a relationship defining the reference current $I_1$ can be provided as in Equation 4.

$$I_1 = \frac{V_{be}}{R_{eff}} \qquad \text{Eq. 4}$$

$$\text{where } R_{eff} = (R_1 - kR_2) \qquad \text{Eq. 5}$$

It should be recognized that the relationship defined by Equation 4 defines a thermally static circuit operation circumstance. However, initial constraints on the selection of the reference current $I_1$, and the design of the reference circuit 12 in general, may be deduced from Equations 3 and 5. The static constraints are: first, the product of the reference current $I_1$ and resistor $R_1$ 36 must be greater than or equal to the base-to-emitter voltage potential difference $V_{be}$ of the transistor $Q_1$ 40; and second, the effective resistance $R_{eff}$ must be greater than zero. The minimum operating voltage requirement of about 1.5 volts is reached from an assumption that the voltage drop across resistor $R_2$ will be about the same as $V_{be}$.

The dynamic thermal performance of the reference circuit 12 may be determined by differentiating Equation 4 with respect to temperature. The resulting relationship is provided as Equation 6.

$$TC_{net} = TC_{Vbe} - \left[\frac{R_1(TC_{R1}) - kR_2(TC_{R2})}{R_{eff}}\right] \qquad \text{Eq. 6}$$

where $TC_{Vbe}$ is the temperature coefficient of the transistor $Q_1$, $TC_{R1}$ is the temperature coefficient of the resistor $R_1$, $TC_{R2}$ is the temperature coefficient of the resistor $R_2$ and $TC_{net}$ is the net (output) temperature coefficient of the reference circuit 12.

For a preferred embodiment of the present invention, the reference current $I_1$ is desired to be constant over temperature. Therefore, the net temperature coefficient given by Equation 6 should be equal to zero for such an embodiment. Setting $TC_{net}$ of Equation 6 equal to zero and simplifying yields Equation 7.

$$R_1(TC_{R1}) = R_{eff}(TC_{Vbe}) + kR_2(TC_{R2}) \qquad \text{Eq. 7}$$

Equation 7 and the static relationship defined by Equation 5 as between the resistor values $R_1$ and $R_2$ and current amplifier constant k can be solved simultaneously using matrix algebra and then substituting for fthe value $R_{eff}$ to isolate the relationship of the resistors $R_1$ and $R_2$ with respect to the reference current $I_1$. The initial matrix equation is given by Equation 8 and the resulting relationships for resistors $R_1$ and $R_2$ are given by Equations 9 and 10, respectively.

$$\begin{bmatrix} 1 & -k \\ TC_{R1} & -kTC_{R2} \end{bmatrix} \begin{bmatrix} R_1 \\ R_2 \end{bmatrix} = \begin{bmatrix} R_{eff} \\ R_{eff}\,TC_{Vbe} \end{bmatrix} \qquad \text{Eq. 8}$$

$$\frac{R_1I_1}{V_{be}} = \frac{TC_{Vbe} - TC_{R2}}{TC_{R1} - TC_{R2}} \qquad \text{Eq. 9}$$

$$\frac{R_2I_1}{V_{be}} = \frac{1}{k}\left(\frac{TC_{Vbe} - TC_{R1}}{TC_{R1} - TC_{R2}}\right) \qquad \text{Eq. 10}$$

In accordance with the preferred embodiments of the present invention, the resistors $R_1$ and $R_2$ are chosen to have temperature coefficients that are complimentary in sign to that of the diode connected transistor $Q_1$. Further, the manner of fabricating the resistors $R_1$ and $R_2$ is chosen to permit the selection of a separate temperature coefficient for each of the resistors $R_1$, $R_2$. Conventionally fabricated transistors, such as diode connected transistor $Q_1$, will have a negative temperature coefficient and a modest magnitude. A typical range of temperature coefficients obtainable with conventional fabrication techniques is from about −3,000 ppm/°C. to about −3,500 ppm/°C. The resistors $R_1$, $R_2$ are preferably fabricated to have a positive temperature coefficient. P-type resistors fabricated in an N-type substrate or N-well will have positive temperature coefficients that can range, using conventional fabrication techniques, from about 400 to about 20,000 ppm/°C. By utilizing differing doping densities, the resistors $R_1$ and $R_2$ can be readily fabricated to have the distinctly different temperature coefficients desired. Preferably, the temperature coefficient of the resistor $R_2$ is chosen to be significantly greater than that of $R_1$ as can be seen to be preferred from Equation 7. At a resistivity of 45 Ohms per square, a typical highly-doped P-type resistor will have a temperature coefficient of about 550 ppm/°C. For a lighter doped P-type resistor providing a resistance value of 2,600 Ohms per square, a temperature coefficient of about 7,000 ppm/°C. can be readily obtained. Thus, for a desired reference current $I_1$ and the characteristics of the devices produced by the particular conventional fabrication process utilized, Equations 9 and 10 permit the values of the resistors $R_1$ and $R_2$ to be selected to ideally achieve a net zero temperature coefficient for the reference circuit 12.

An alternate embodiment of the present invention provides for the optimization of the reference circuit 12 to operate as a temperature compensated voltage level reference. This is achieved by selecting the thermal coefficient and values of the transistor $Q_1$ and resistors $R_1$ and $R_2$ such that a temperature invariant voltage level is established at the drain of the transistor 18; effectively the voltage reference output of the reference circuit 12. From Equation 7, the net thermal coefficient contribution of the transistor $Q_1$ and resistor $R_2$ are selected to equal zero as shown in Equation 11.

$$0 = R_{eff}(TC_{V_{be}}) + kR_2(TC_{R2}) \qquad \text{Eq. 11}$$

That is, by fixing the voltage at the drain of transistor 32 with respect to the positive source potential over temperature, the voltage appearing at the drain of transistor 18 is fixed with respect to the negative source potential over temperature. Empirically, as the resistive value of the resistor $R_1$ changes with temperature, the gate-to-source potential difference of transistor 30 will change proportionately, resulting in a constant voltage appearing at the effective output terminal 24 of the reference circuit 12. The relationships between the values and thermal coefficients of the transistor $Q_1$ and resistor $R_1$, $R_2$ can again be derived from equation 8 by allowing $TC_{R1}$ to equal zero. The resulting relationships for resistors $R_1$ and $R_2$ are defined by Equations 12 and 13, respectively.

$$\frac{R_1 I_1}{V_{be}} = \frac{TC_{V_{be}} - TC_{R2}}{-TC_{R2}} \qquad \text{Eq. 12}$$

$$\frac{R_2 I_1}{V_{be}} = \frac{1}{k}\left(\frac{TC_{V_{be}}}{-TC_{R2}}\right) \qquad \text{Eq. 13}$$

The reference circuit 12, in accordance with another preferred embodiment of the present invention, can be optimized for use as both a current and a voltage level reference. For such an embodiment, Equations 12 and 13 are utilized to select the component values and characteristics of the resistors $R_1$ and $R_2$ and the transistor $Q_1$. Further, the fabrication of the resistor $R_1$ is preferably such as to independently minimize its temperature coefficient. For this embodiment, the variance in $I_1$ over temperature is almost entirely attributable to the temperature coefficient of $R_1$. Therefore, minimizing the temperature coefficient of $R_1$ in combination with the selection of $Q_1$ and $R_2$ for an output voltage invariant with respect to temperature yields a combined current and voltage reference capability. The fabrication of resistor $R_1$ with a minimum temperature coefficient is preferably achieved by Silicon-Chrome thin film deposition.

Considering the reference circuit 12 again in general terms and with respect to the implementation of its currently preferred best modes, the power bootstrap circuit 14 is provided to initiate proper operation upon application of power. Initially, the gate of the transistor 44, connected to the output terminal 24 of the reference circuit 12, is at or close to the negative source potential. Consequently, transistor 44 is held off. The source of transistor 44 and gate of a current forcing, depletion mode transistor 50 are pulled, by virtue of a resistor 48 ($R_3$), to the positive source potential. The drain 52 of the current forcing transistor 50 is coupled to the positive source conductor 38 while its source 54 is coupled to the drain 24 of transistor 18. The current forcing transistor 50 therefore acts to control a current feed of a start-up current $I_1'$ to the current mirror 18, 20. As the transistors 18, 20 are thereby forced to switch on, the transistor 44 of the power-on bootstrap circuit is also driven on. Consequently, the current forcing transistor 50 is forced off. Thereafter, the power-on bootstrap circuit 14 effectively ceases to participate in the operation of the reference circuit 12.

The output stage 16 is illustrative of two separate, but not mutually exclusive techniques for preparing the output reference level of the reference circuit 12 for subsequent use. Transistors 60 and 66, combine to provide a conventional bipolar current drive and shifted voltage level capability on the output line 64. Transistor 68 provides a simple, conventional current sink capability on the output line 70.

EXAMPLE

An embodiment of the present invention substantially as shown in the FIGURE has been fabricated on a standard silicon wafer. A conventional fabrication process was utilized to obtain the following selected device specifications:

| | | |
|---|---|---|
| $R_1$ | Ohms (calculated) | 10K Ohm |
| | (measured) | 9.7K Ohm |
| | TC (measured) | 550 ppm/°C. |
| | Resistor Dimensions | W - 10 μm |
| | | L - 220 μm |
| | Doping Density | $1 \times 10^{19}$ cm$^{-3}$ |
| $R_2$ | Ohms (calculated) | 14.4K Ohm |
| | (measured) | 14.9K Ohm |
| | TC (measured) | 7,000 ppm/°C. |
| | Resistor Dimensions | W - 10 μm |
| | | L - 55 μm |
| | Doping Density | $1 \times 10^{16}$ cm$^{-3}$ |
| $Q_1$ | Type | Bipolar |
| | $V_{be}$ (calculated) | 0.68 V |
| | (measured) | 0.67 V |
| | TC (measured) | 3,000 ppm/°C. @ 25° C. |
| $Q_2$ | Type | NMOS |
| | Channel Dimensions | W - 120 μm |
| | | L - 15 μm |
| $Q_3$ | Type | NMOS |
| | Channel Dimensions | W - 30 μm |
| | | L - 15 μm |
| $Q_4$ | Type | PMOS |
| | Channel Dimensions | W - 400 μm |
| | | L - 20 μm |
| $Q_5$ | Type | PMOS |
| | Channel Dimensions | W - 100 μm |
| | | L - 20 μm |

The operating characteristics of the fabricated embodiment of the invention, upon thermal sensitivity characterization testing, was found to be at or less than 1000 ppm/°C. without trimming of the $R_1$ and $R_2$ resistor values over a temperature range of 25° to 125° C.

After trimming the resistors $R_1$,$R_2$, the thermal sensitivity of the reference was measured at about 100 ppm/°C. over the temperature range of 25° to 125° C. The trimming of the resistors $R_1$,$R_2$ was accomplished by first determining, by reverse calculation, the required values in view of the tested, untrimmed performance of the fabricated embodiments. The resistors $R_1$, $R_2$ were then trimmed by blowing fusible links, provided as a series conductive taps positioned along the length of the resistor. Consequently, the effective length, and therefore resistivity, of the resistors where adjusted.

Thus, a temperature compensated reference circuit capable of being optimized for establishing a constant current or a constant voltage level, or both, and operating at source potential differences of down to about 1.5 volts has been described.

Naturally, the detailed illustrative embodiments of the present invention disclosed herein exemplifies the invention and provides the teachings from which many modifications and variations may be made without departing from the present invention in its broader aspects. It is therefore to be understood that, within the scope of the appended claims, the present invention may be practiced otherwise than as specifically described herein.

I claim:

1. A circuit for providing an output reference level that is fixed with respect to temperature, said circuit comprising:

(a) current mirror means for providing first and second current paths for the conduction of first and second currents, respectively, and for imposing a current level relationship between said first and second currents;

(b) primary load means for primarily establishing a predetermined level of said first current; and (c) secondary load means for imposing a predetermined temperature characteristic on said second current, said secondary load means including a first element in said second current path having a temperature coefficient of a predetermined polarity and a second element in said second current path having a temperature coefficient of a complementary polarity;

(d) primary load compensation means, responsive to the temperature characteristic of said second current as imposed by said secondary load means, for effectively altering the load value of said primary load means with respect to temperature.

2. The circuit of claim 1 wherein said primary load compensation means includes variable load means for providing an adjustable load in said first current path, the load value of said variable load means being responsive to the temperature characteristic of said second current as imposed by said secondary load means.

3. The circuit of claim 2 wherein said first element includes a transistor, said second element includes a resistor in series with said first element in said second current path and said primary load means includes a resistor, the resistors of said second element and primary load means having like temperature coefficient polarities and differrent temperature coefficient magnitudes.

4. The circuit of claim 3 wherein said first and second element are a diode connected transistor and a P-type integrated resistor.

5. The circuit of claim 4 wherein said primary load means is a P-type resistor and said variable load means includes a transistor.

6. A circuit for establishing a temperature insensitive operating set-point, said circuit comprising:

(a) current mirror means, referenced to a first potential level, for providing first and second parallel current paths for the conduction of respective first and second currents, said current control means imposing a current level relation between first and second currents;

(b) first resistor means, referenced to a second potential level, for establishing a first resistance value, said first resistor means including a diode and a resistor coupled in series in said second current path, said transistor and resistor having respective first and second predetermined temperature coefficients that combine to establish said first resistor means as having a predetermined net temperature coefficient;

(c) second resistor means, coupled in said first current path to said second potential level, for providing a second resistance value to establish a predetermined level of said first current in said first current path, said second resistor means having a third predetermined temperature coefficient; and (d) feedback means, coupled to said current mirror means in said first and second current paths, for adjusting the potential difference developed with respect to the resistive value of said second resistor means and said first current in response to variation in a potential difference developed with respect to the resistive value of said first resistor means and said second current.

7. The circuit of claim 6 wherein said feedback means includes first and second transistors configured as a current mirror amplifier, said first and second transistors provided in said first and second current paths, respectively, said first transistor being responsive to said second transistor such that the current density of said first current through said first transistor is proportional to the current density of said second current through said second transistor.

8. The circuit of claim 7 wherein said first and second temperature coefficients of said resistor and diode of said first resistor means are of complementary polarity and wheein the magnitude of said first and second temperature coefficients of said resistor and diode of said first resistor means are comparable such that said predetermined net temperature coefficient is between about zero and that of said third predetermined temperature coefficient.

9. The circuit of claim 8 wherein said diode of said first resistor means is a diode connected bipolar transistor and wherein said resistor of said first resistor means is connected in series between the emitter of said diode connected bipolar transistor and said second transistor of said feedback means, said base and collector of said diode connected bipolar transistor being coupled to said second potential level.

10. The circuit of claim 9 wherein said second resistor means is a resistor coupled between said second potential level and said first transistor of said feedback means, wheein said resistors of said first and second resistor means are integrated resistors and wherein said said resistors of said first and second resistor means are integrated having complementary conductivity type so as to have substantially different temperature coefficients.

11. A circuit for providing a temperature compensated reference current level, said circuit comprising:

(a) current mirror means for providing first and second current paths for conducting first and second currents, respectively, and for establishing a first current level relationship between said first and second currents;

(b) first current limiting means, coupled in series in said first current path, for resistively limiting said first current, said first current limiting means having a first predetermined temperature coefficient; and (c) second current limiting means, coupled in series in said second current path, for resistively limiting said second current, said second current limiting means including a resistor and transistor having second and third predetermined temperature coefficients, respectively, said second current limiting means having a fourth predetermined temperature coefficient that is dependent on said second and third predetermined temperature coefficients.

12. The circuit of claim 11 wherein said fourth predetermined temperature coefficient is approximately the same as said first temperature coefficient such that said first current is substantially constant over temperature.

13. The circuit of claim 12 wherein said fourth predetermined temperature coefficient is approximately zero such that said first current varies in inverse proportion with the ambient temperature.

14. The circuit of claim 11 or 12 wherein said second and third predetermined temperature coefficients are of complementary polarity, and wherein said first and second predetermined temperature coefficients are of complementary polarity.

15. The circuit of claim 14 further comprising a current mirror amplifier interposed in said first and second current paths between said current mirror means and said first and second current limiting means, said current mirror amplifier defining a relationship between the voltage drop across said first current limiting means and the voltage drop across said second current limiting means such that variation in the voltage drop across said second current limiting means controls a corresponding modification of the voltage drop across said first current limiting means.

16. A circuit for providing a reference level output, said circuit comprising:

(a) first and second transistors having respective first, second and control terminals, said first terminals of said first and second transistors being commonly connected to a first supply potential, said control terminals of said first and second transistors being connected together and to said second terminal of said first transistor to provide the reference level output;

(b) third and fourth transistors having respective first, second and control terminals, said first terminals of said third and fourth transistors being respectively connected to said second terminals of said first and second transistors, said control terminals of said third and fourth transistors being connected together and to said first terminal of said second transistor;

(c) a first resistor coupled between said second terminal of said third transistor and a second supply potential, said first resistor having a first temperature coefficient;

(d) a second resistor having first and second terminals, said first terminal coupled to said second terminal of said fourth transistor, said second resistor having a second temperature coefficient; and (e) a diode having first and second terminals, said first terminal of said diode being coupled to said second terminal of said second resistor and said second terminal of said diode being coupled to the second supply potential, said diode having a third temperature coefficient, said second resistor and said diode being selected such that said second and third temperature coefficients have a predetermined net temperature coefficient.

17. The circuit of claim 16 wherein said second and third temperature coefficients are of complementary polarity and wherein said predetermined net temperature coefficient is zero, whereby said output reference level is representative of a constant current flow, with respect to temperature, through said first transistor.

18. The circuit of claim 17 wherein said predetermined net temperature coefficient is substantially the same as said first temperature coefficient, whereby said output reference level is a constant voltage level with respect to temperature.

19. The circuit of claim 16, 17 or 18 wherein said first and second temperature coefficients are of complementary polarity and wherein said second and third temperature coefficients are of complementary polarity.

20. The circuit of claim 19 further comprising:

(a) means for initiating the operation of said circuit to provide said output reference level; and (b) means for buffering said output reference level.

* * * * *

UNITED STATES PATENT AND TRADEMARK OFFICE

CERTIFICATE OF CORRECTION

PATENT NO. : 4,769,589

DATED : September 6, 1988

INVENTOR(S) : Bruce D. Rosenthal

It is certified that error appears in the above-identified patent and that said Letters Patent is hereby corrected as shown below:

Column 4, line 24, A space should be inserted above Equation 7.

Column 4, line 29, "for fthe" should read --for the--.

Column 7, line 11, "where adjusted" should read --were adjusted--.

Column 8, line 47, "wheein" should read --wherein--.

Column 8, line 64, "wheein" should read --wherein--.

Signed and Sealed this

Ninth Day of May, 1989

*Attest:*

DONALD J. QUIGG

*Attesting Officer*

*Commissioner of Patents and Trademarks*